US007628659B2

(12) United States Patent
Thompson

(10) Patent No.: US 7,628,659 B2
(45) Date of Patent: Dec. 8, 2009

(54) ENHANCED CABLE FOR FIELD DATA DISTRIBUTION SYSTEM

(75) Inventor: Alvin Dean Thompson, St. Joseph, MO (US)

(73) Assignee: DT Search & Designs LLC, St. Joseph, MO (US)

( * ) Notice: Subject to any disclaimer, the term of this patent is extended or adjusted under 35 U.S.C. 154(b) by 0 days.

(21) Appl. No.: 12/355,596

(22) Filed: Jan. 16, 2009

(65) Prior Publication Data

US 2009/0181582 A1 Jul. 16, 2009

Related U.S. Application Data

(63) Continuation-in-part of application No. 12/033,296, filed on Feb. 19, 2008, which is a continuation-in-part of application No. 11/803,888, filed on May 16, 2007, now Pat. No. 7,445,520, which is a continuation of application No. 11/168,580, filed on Jun. 28, 2005, now Pat. No. 7,238,063.

(60) Provisional application No. 60/583,505, filed on Jun. 28, 2004.

(51) Int. Cl.
*H01R 9/22* (2006.01)

(52) U.S. Cl. ..... 439/709; 174/113 R

(58) Field of Classification Search ..... 439/535, 439/578, 580, 709; 174/113 C, 113 R
See application file for complete search history.

(56) References Cited

U.S. PATENT DOCUMENTS

| | | | | |
|---|---|---|---|---|
| 6,608,255 | B1 * | 8/2003 | Donner et al. | 174/110 R |
| 6,764,356 | B2 * | 7/2004 | Becher et al. | 439/835 |
| 6,875,928 | B1 * | 4/2005 | Hayes et al. | 174/113 R |
| 7,097,516 | B2 * | 8/2006 | Werner et al. | 439/709 |
| 7,399,927 | B2 * | 7/2008 | Glew | 174/113 C |
| 7,465,879 | B2 * | 12/2008 | Glew | 174/113 R |

* cited by examiner

*Primary Examiner*—Thanh-Tam T Le
(74) *Attorney, Agent, or Firm*—Polsinelli Shughart PC; Dennis A. Crawford

(57) ABSTRACT

An enhanced cable assembly for field data distribution system includes a cable member formed by a plurality of twisted conductor pairs bundled within a conductive shield and an insulative sheath. The cable assembly is terminated by a pair of multi-contact cable connectors, each including a conductive shell, a contact array board supported in the shell, and a weather seal. The cable connectors are of a standard configuration for use with standardized field data distribution boxes. The contact board array is of such a configuration as to enable two cable connectors to be joined to thereby interconnect two such cables. The enhanced cable assembly is constructed to comply with Category 5E specifications.

24 Claims, 9 Drawing Sheets

ENHANCED CABLE FOR FIELD DATA DISTRIBUTION SYSTEM

CROSS-REFERENCE TO RELATED APPLICATION

This is a continuation-in-part of U.S. patent application, Ser. No. 12/033,296, filed Feb. 19, 2008 for FIELD DATA DISTRIBUTION SYSTEM WITH FIBER OPTIC CONVERTER, which is a continuation-in-part of U.S. patent application, Ser. No. 11/803,888, filed May 16, 2007 now U.S. Pat. No. 7,445,520 for FIELD COMMUNICATION AND COMPUTER DATA DISTRIBUTION SYSTEM, which is a continuation of U.S. patent application, Ser. No. 11/168,580 filed Jun. 28, 2005 for FIELD COMMUNICATION AND COMPUTER DATA DISTRIBUTION SYSTEM, which issued as U.S. Pat. No. 7,238,063 and which claims priority under 35 U.S.C. 119(e) and 37 C.F.R. 1.78(a)(4) based upon U.S. Provisional Application, Ser. No. 60/583,505 for FIELD COMMUNICATION AND COMPUTER DATA DISTRIBUTION SYSTEM, filed Jun. 28, 2004; the disclosures of Ser. Nos. 12/033,296, 11/803,888, and 60/583,505 and U.S. Pat. No. 7,238,063 being incorporated herein by reference.

BACKGROUND OF THE INVENTION

The present invention relates to field communication distribution equipment and, more particularly, to improvements in cables for such equipment to increase data throughput of such cables without increasing cross-talk and other interference between data communication channels between the distribution equipment.

The J-1077 A/U distribution box (hereinafter referred to simply as the "J-1077") is used to interconnect military field telephones and other communication devices in mobile, transportable, and semi-permanent installations. The J-1077 has provisions for connection of one or two 26 conductor-pair cables to a set of 26 pairs of spring post connectors mounted on a panel within the box. The standard cable for use with J-1077 type boxes is designated CX-4566 A/G. As such, the J-1077 can interconnect two 26-pair cables or can terminate a single 26-pair cable and provide connections to the conductors within the cable, such as for telephone sets or test equipment. The J-1077 has been in use for several decades and has proved to be generally rugged and reliable in varied field conditions. Additional information about the J-1077 distribution box can be obtained from Associated Industries of North Hollywood, Calif. (www.associated-ind.com) and from other sources.

Although generally successful, the J-1077 has some shortcomings. The configuration of the spring post connectors requires that wires be stripped before insertion into the posts. Stripping sometimes damages some of the strands of a conductor, causing them to break off, thereby reducing the signal carrying capability of the conductor. Stripping is also time-consuming if a large number of connections need to be made at one time.

Another problem with the J-1077 is that if a communication malfunction occurs in a system using J-1077 distribution boxes and cables, it is often difficult and time-consuming to isolate the problem among the possible 26 circuits which may be in use. At present, the usual procedure is to disconnect and reconnect each wire until the problem is isolated. A related problem is detecting the location of a break or cut in the cable or unauthorized connections to the network, such as by an enemy. Additionally, there are no provisions on a standard J-1077 box for connection of computers thereto to enable field networking of computers or data communication between computerized devices using the J-1077 system.

Some types of military communication equipment have optical data signal interfaces which utilize optical fiber communication media. Optical data signals have a number of advantages in military applications, including high efficiency over long distances, high data rates, difficulty of tapping by an enemy, and the like. There is also a need for converting signals carried by optical fiber media to electrical data signals for carriage by conventional copper based cables.

The J-1077 distribution box and the standard CX-4566 A/G cable, were originally designed for carrying multiple channels of audio frequency telephone signals. As stated above, military field communications have evolved beyond voice and teletype communications to high speed data communications for text, numeric, and image data in addition to voice signals. It is desirable that such communications be carried on using standard data communication protocols to enable existing equipment and devices to be used to thereby avoid the expense need for designing

SUMMARY OF THE INVENTION

The present invention provides an enhanced cable for field data distribution systems. In particular, the present invention provides embodiments of cables for interconnection of J-1077 type distribution boxes which have been upgraded for carrying computer network signals, such as Ethernet type signals.

In the present invention, the spring post connectors of conventional J-1077 boxes are replaced by sets of insulation displacement connectors (IDC) mounted on a connector panel. Each insulation displacement connector generally has a movable top section which comprises two wire insertion holes and a lower fixed section which houses a pair of terminal strips. The terminal strips have a wire engaging portion at one end for engaging and making electrical contact with a wire. The terminal strips are generally parallel to one another but offset to provide a sufficient dielectric strength between them. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed. Each spring binding post on the connector panel of the J-1077 distribution box is replaced by an insulation displacement connector unit. The connectors of the present invention are mounted on the J-1077 panel in pairs in the same manner as the spring binding posts they replace.

The connectors typically carry audio frequency communication signals. In order to facilitate troubleshooting to find which circuit may have a problem, it is a common practice to remove a conductor from a binding post, one at a time, until the problem circuit is identified. Such disconnecting and reconnecting is laborious and can damage the stripped wire ends, requiring that the wire end be stripped before reconnecting. The present invention overcomes this problem by providing a test switch in at least one conductor of each pair. By this means, the test switch can be opened to disconnect the circuit instead of physically removing the conductor from the connector. Preferably, a double pole, single throw switch is connected between the pairs of terminals of the pair of connector devices.

The present invention provides a means of detecting the approximate location of a cut or break in one of a series of interconnected cables of the type that are used with the J-1077 distribution box. Typically, the cables are formed by 26 numbered pairs of conductors. Normally, only 25 pairs carry communication signals, while the No. 26 pair is used for testing and troubleshooting purposes. The present invention provides at least one resistor per cable, connected across the No. 26 conductor pair. When a plurality of cables are interconnected end to end by J-1077 boxes, the resistors of the cables are connected in parallel. If the resistance of the parallel combination is measured, the number of unbroken cable sections can be determined from the composite resistance and compared with the composite resistance expected from the number of cables present.

A standard resistor may also be connected across each end of the No. 26 pair of each cable section. By this means, the integrity of a single cable section can be determined by measuring the resistance across the No. 26 conductor pair.

In order to provide for digital communications between computers and computerized equipment, the improved J-1077 type distribution box of the present invention may have some of the insulation displacement connectors interconnected to connectors more appropriate for computer networks or for interconnections between modems. Such connectors can include, but are not limited to, RJ-45 (8P8C), RJ-11, and RJ-12 modular type connectors; BNC type connectors; and other connectors commonly employed for interconnections between computers. Conductors of the cables interconnecting the improved J-1077 boxes and carrying data between computers may be shielded separately from the other conductor pairs to minimize possible interference to and from other signals on other conductor pairs. Data connectors and associated cable conductors would provide some limited computer networking capabilities in addition to more conventional analog voice communications in systems employing J-1077 type distribution boxes. Alternatively, other types of connectors can be connected to selected insulation displacement connectors, such as standard phone connectors, F-type connectors, fiber optic adapters, and other standard types of network, telephone, audio, video, and signal connectors. The insulation displacement connectors and the auxiliary connectors are connected to a pair of box connectors positioned on opposite sides of the box to enable the distribution box to be connected to other boxes. The box connectors have sets of contacts which correspond to the conductors of the insulation displacement connectors and the auxiliary connectors. A preferred type of box connector is designated U-187 A/G which is referred to as a side mount connector in which a side of the box connector structure is joined to the side wall of the box. It is foreseen that the box connector could alternatively be a U-186 C/G connector which is substantially similar to the U-187 A/G except that the U-186 C/G connector is joined to a side wall of the box by an end of the connector structure.

An embodiment of the distribution box of present invention is provided with a media converter for converting between optical data signals and electrical data signals. A standard type of fiber optic connector is provided on the connector along with a standard type of electrical data connector. The fiber optic connector may, for example, be an ST type of optical connector while the electrical connector is an RJ-45 connector. Media converter circuitry is interfaced to the optical and electrical data connectors and bilaterally converts between a standard optical data format and a standard electrical data format. The formats may, for example be 1000Base-SX for the optical data format and 1000Base-T for the electrical data format. Electrical power for operation of the media converter circuitry may be provided by a transformer and rectifier unit connected to a power strip or generator, a battery of an appropriate size, or the like.

In one embodiment of the invention, an enhanced cable includes a plurality of pairs of cable conductors positioned within a conductive shield and an insulative tubular sheath. The cable may also include an outer "armor" layer which reduces damage from being chewed by animals and from other hazards. Each end of the cable includes a cable connector with a plurality of sets of contacts to which the cable conductors are connected. The cable connector is configured to be compatible with the configuration of the box connector. The conductor pairs, in cooperation with the cable connector, are configured to comply with Category 5E specifications, often referred to as Cat 5E. Category 5E conductor pairs are typically twisted at a twist pitch of three twists per inch (2.54 cm). Preferably, the twist is maintained within the cable connector to within one-half inch (12.7 mm) of the contact terminal set to which the conductors are soldered. It is foreseen that the conductor pairs and connector could be configured to specifications more stringent than Category 5E.

Typically, both ends of the enhanced cable will have U-185 B/G connectors which are compatible with both the U-187 A/G and U-186 C/G box connectors. The U-185 B/G connector is a "genderless" type of connector and may also be connected to another U-185 B/G connector to thereby connect one cable to another cable. The cable may also be provided at one end with another type of connector, such as a standard type of multi-contact cylindrical connector designated MS-27467 or AE167, often referred to as a barrel or Cannon connector.

Various objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
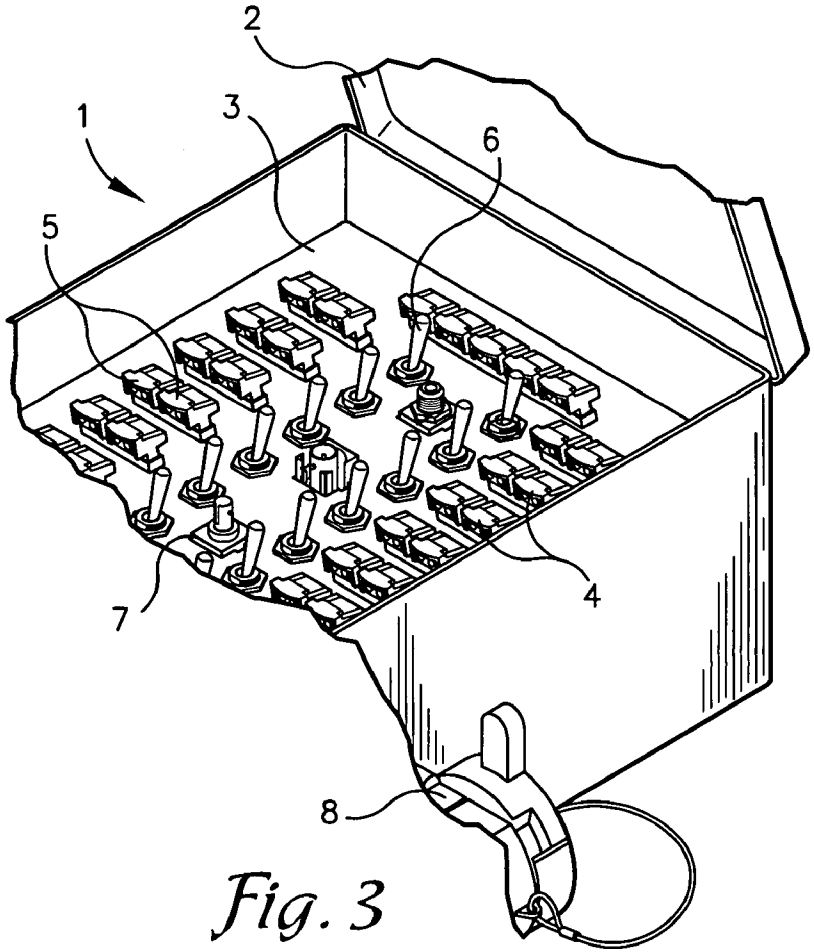
FIG. 3 is an enlarged fragmentary perspective view similar to FIG. 2 and illustrates elements the modified J-1077 box in more detail.

Referring to the drawing in more detail, the reference numeral 1 (FIGS. 2 and 3) generally designates an improved field communication distribution box which embodies the present invention. The box 1 generally includes an access door or lid 2 hingedly connected thereto and a connector panel 3 positioned in the box 1 and having pairs 4 of insulation displacement connectors 5, test switches 6, and auxiliary connectors 7 mounted thereon. The box 1 has box connectors 8 mounted on sides thereof to enable connection of cables 9 to the connectors 5 and 7 thereof. Conversely, the connectors 5 and 7 enable connection of communication devices 10 to the cables 9 (FIG. 1) for communication with other devices 10 (FIG. 1) connected to the cables 9.

Figure 1:
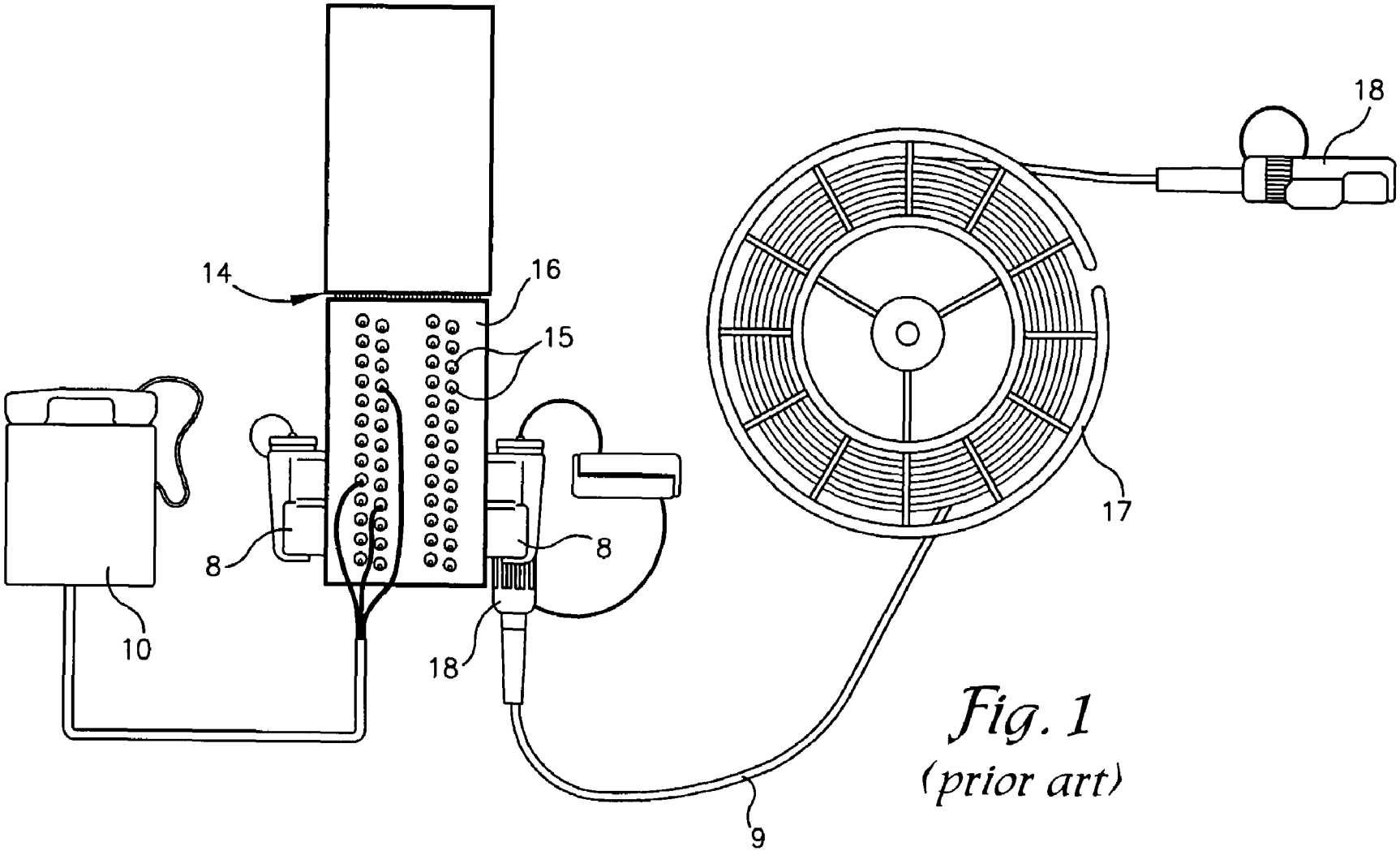
Fig. 1 (prior art)
FIG. 1 is a view of a J-1077 field communication distribution box along with a cable reel and cable and a telephone set.

Referring to FIG. 1, the conventional field communication distribution box 14, with the military designation J-1077 A/U or simply J-1077, has a plurality of spring post connectors 15 mounted on a panel 16. The box 14 has the capability of interconnecting a pair of the cables 9 and provides for the connection of communication devices 10, such as telephone sets, to conductor pairs in the cables 9. FIG. 1 shows a cable reel 17 on which a cable 9 is stored and from which it is paid out from one box 14 to the next. The illustrated cable 9 (designated as CX-4566 A/G) has 26 numbered pairs of conductors and terminates at each end in a multi-terminal cable connector 18 (designated as a U-185 B/G connector). The cable connectors 18 mate with one of the box connectors 8 (designated U-187 A/G connectors) to interconnect two cables 9 and to enable connections of the devices 10 to the conductors of the cables 9.

Figure 7:
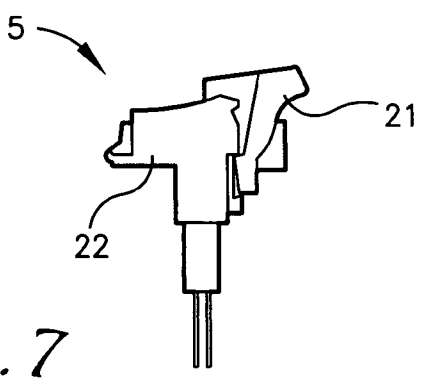
FIG. 7 is a greatly enlarged side elevational view of an insulation displacement connector used in the modified J-1077 distribution box of the present invention, with a top section shown in a closed position.
Figure 8:
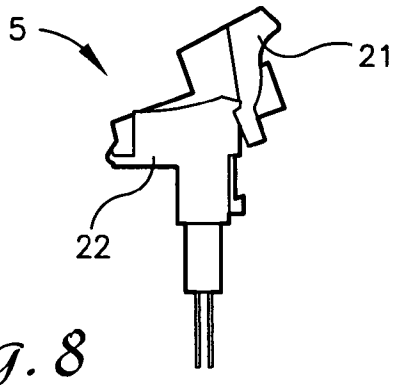
FIG. 8 is a view similar to FIG. 7 and illustrates the insulation displacement connector with the top section shown in an opened position.

The insulation displacement connector 5 generally has a movable top section 21 which comprises two wire insertion holes and pivotally connected to a lower fixed section 22 which houses a pair of terminal strips. The terminal strips (not shown) have a wire engaging portion at one end for engaging and making electrical contact with a wire. The terminal strips are generally parallel to one another but offset to provide a sufficient dielectric strength between them. The top movable section 21 of the connector 5 pivots about a fixed axis located toward the back side of the connector. The top section 21 has a movable latch member to maintain the top section in its closed position. To open the top section, a user the top section to its raised or open position (FIG. 8). When the top section is open, the terminal strips do not intersect the wire insertion holes, and when the top section is closed (FIG. 7), the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are forced through the terminal strip engaging portion to make electrical and mechanical contact with the terminal strips. To remove the wires and/or break the electrical connection, the process is reversed. A preferred type of insulation displacement connector 5 is manufactured by Channell Commercial Corporation of Temecula, Calif. (www.channellcomm.com) and sold under the trademark Mini-Rocker. Such connectors are also sometimes referred to as Mil-Lok connectors.

Figure 9:
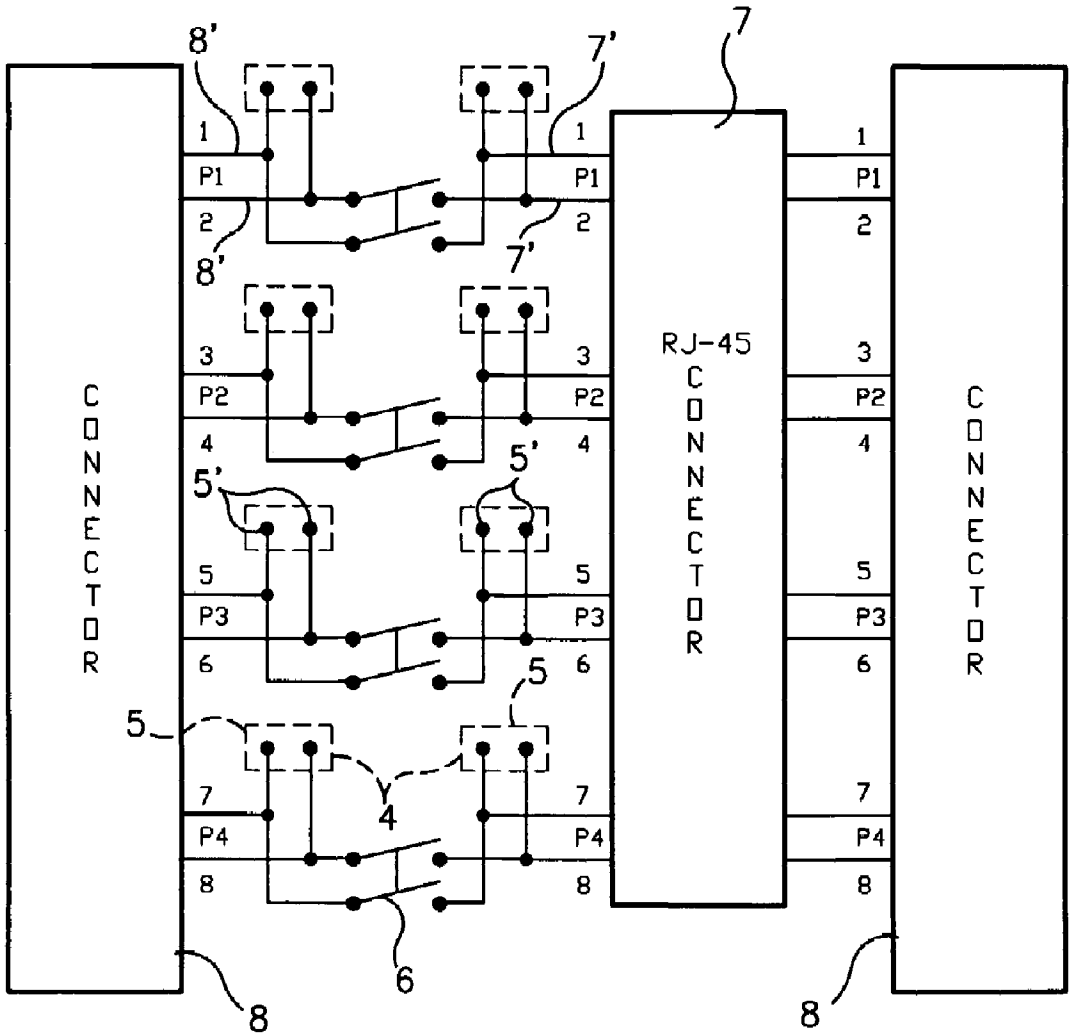
FIG. 9 is a schematic diagram illustrating test switches interconnecting terminals of pairs of insulation displacement connectors of the modified J-1077 distribution box of the present invention and further illustrates the connection of a multiconductor connector to a plurality of pairs of the insulation displacement connectors.

Each set spring binding posts 15 on the connector panel of the conventional J-1077 distribution box 14 is replaced by a set 4 of insulation displacement connector units or connector devices 5. The pair of connector units 5 provides for redundancy should one of the receptacles malfunction or be damaged. The insulation displacement connectors 5 enable faster and more reliable connections since the wires to be inserted do not require stripping. The terminals 5' (FIG. 9) of each connector unit 5 are connected to associated pairs of contacts or conductors 8' in the box connectors 8. Referring to FIG. 9, the terminals of a first one of the pair 4 of connector units 5 are connected to the box connector 8 on one side of the box 1 while the terminals of the second of the pair 4 are connected to the box connector 8 on the opposite side of the box 1.

In order to facilitate troubleshooting to find which circuit may have a problem, it is a common practice with the older box 14 to remove a conductor from a binding post 15, one at a time, until the problem circuit is identified. Such disconnecting and reconnecting is laborious and can damage the stripped wire ends, requiring that the wire end be stripped before reconnecting. The present invention overcomes this problem by providing a test switch 6 to interconnect the sets of terminals of each pair 4 of connector units 5. A double pole, single throw switch configuration is preferred. When the switch contacts are closed, the terminals of each pair 4 are interconnected. However, when the switch contacts are opened, the conductors of cables 9 on both sides of the box 1 can be individually tested, without removing wires from the connector units 5.

The present invention provides a means of detecting the approximate location of a cut or break in one of a series of interconnected cables 9. Typically, the cables 9 are formed by 26 numbered pairs of conductors. Normally, only 25 pairs carry communication signals, while the No. 26 pair is used for testing and troubleshooting purposes.

Figure 10:
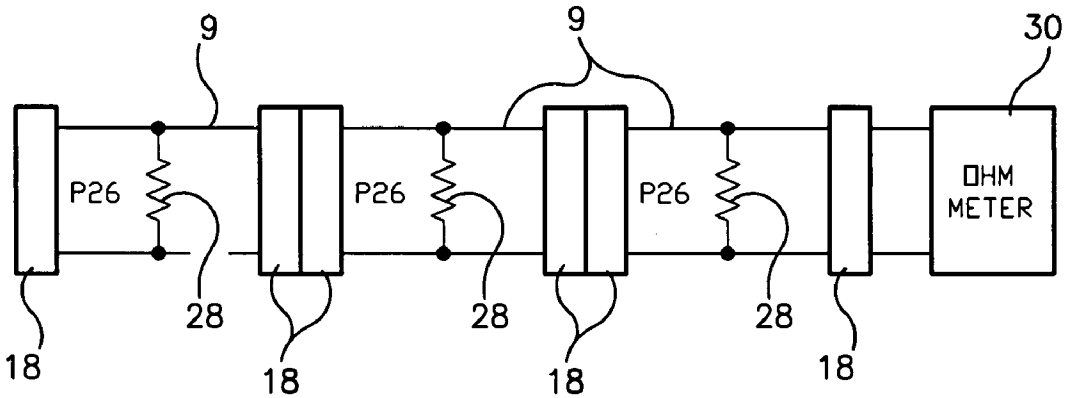
FIG. 10 is a schematic diagram illustrating a plurality of interconnected cables of the present invention with resistors to enable the location of a break in a cable.

Referring to FIG. 10, the present invention provides at least one resistor 28 per cable, connected across the No. 26 conductor pair. The value of the resistor is standardized and may range from about 1000 ohms (1 kilohm) to several hundred kilohms. A number of cables 9 are normally strung together end-to-end using boxes 10 or other kinds of appropriate connectors. Normally, a technician will be aware of the exact number of cables 9 present in a given communication network. Each cable 9 added, in the present invention, connects an additional resistor 28 in parallel, thereby further dividing the equivalent resistance of all the interconnected resistors 28. Additionally, the resistance of a given length of the conductor pair is known. The unbroken length of the composite cable is related to the equivalent resistance measured across the No. 26 conductor pair. If the value of the standard resistor is relatively high, the in-line resistance of the conductor pair is less significant in proportion to the standard resistors, such that the equivalent resistance of the cable is effectively the parallel combination of the standard resistors. Thus, the equivalent resistance of the cable is inversely proportional to the length of the composite cable.

For example, if the composite cable is formed by ten cable sections, each with a standard resistor connected across the No. 26 pair, then the equivalent resistance measured is one tenth of the value of the standard resistor. However, if ten cable sections should be present and the resistance measured by an ohm meter 30 from one end is, for example, one seventh the value of the standard resistor, then the technician knows that there is a break in the eighth section. By this means, the broken cable section can be replaced or repaired quickly and directly without the need to inspect each section. Alternatively, resistor 28 may be connected across each end of the No. 26 pair of each cable section 9. By this means, the integrity of a single cable section 9 can be determined by measuring the resistance across the No. 26 conductor pair.

The present invention also contemplates connecting a cable monitor circuit to the No. 26 cable pair which monitors the equivalent resistance of the composite cable. Such a cable monitor would preferably be based on a programmable digital computer or at least a programmable microprocessor to provide for a variety of desirable features. The number of sections and the value of the standard resistor are entered into the monitor circuit. If the monitored resistance varies by greater than a selected tolerance, an alarm is activated. The change in resistance could be a consequence of the cable being damaged or being disconnected by an enemy to insert listening equipment into the line. In either case, once the occurrence to line interruption has been alerted, the approximate location of the break can be located by the procedures described previously.

In some applications, it may be desirable to provide in-line electrical fuses (not shown) to the conductors of the cable to protect circuits and equipment connected thereto. Such fuses may be rated at relatively low levels of current, such as 375 milliamperes, because of the relatively low power levels of signals intended to be carried by the conductors of the system. The fuses protect the circuits connected thereto from damage due to short circuits, current surges, and the like. The fuses are preferably provided in such a manner that they can be easily replaced if blown.

In order to provide for digital communications between computers and computerized equipment, the improved type distribution box 1 of the present invention may have various types of auxiliary connectors 7 having auxiliary connector terminals 7' interconnected to the terminals 5' of the insulation displacement connector units 5. Such connectors can include, but are not limited to, RJ-45 (8P8C), RJ-11, and RJ-12 modular type connectors; BNC type connectors; F-type connectors, fiber optic adapters, and other connectors commonly employed for interconnections between computers, computer networks, modems, and the like. Conductors of the cables 9 interconnecting the boxes 1 and carrying data between computers may be shielded separately from the other conductor pairs to minimize possible interference to and from other signals on other conductor pairs. Data connectors and associated cable conductors would provide some limited computer networking capabilities in addition to more conventional analog voice communications in systems employing conventional J-1077 type distribution boxes.

Figure 4:
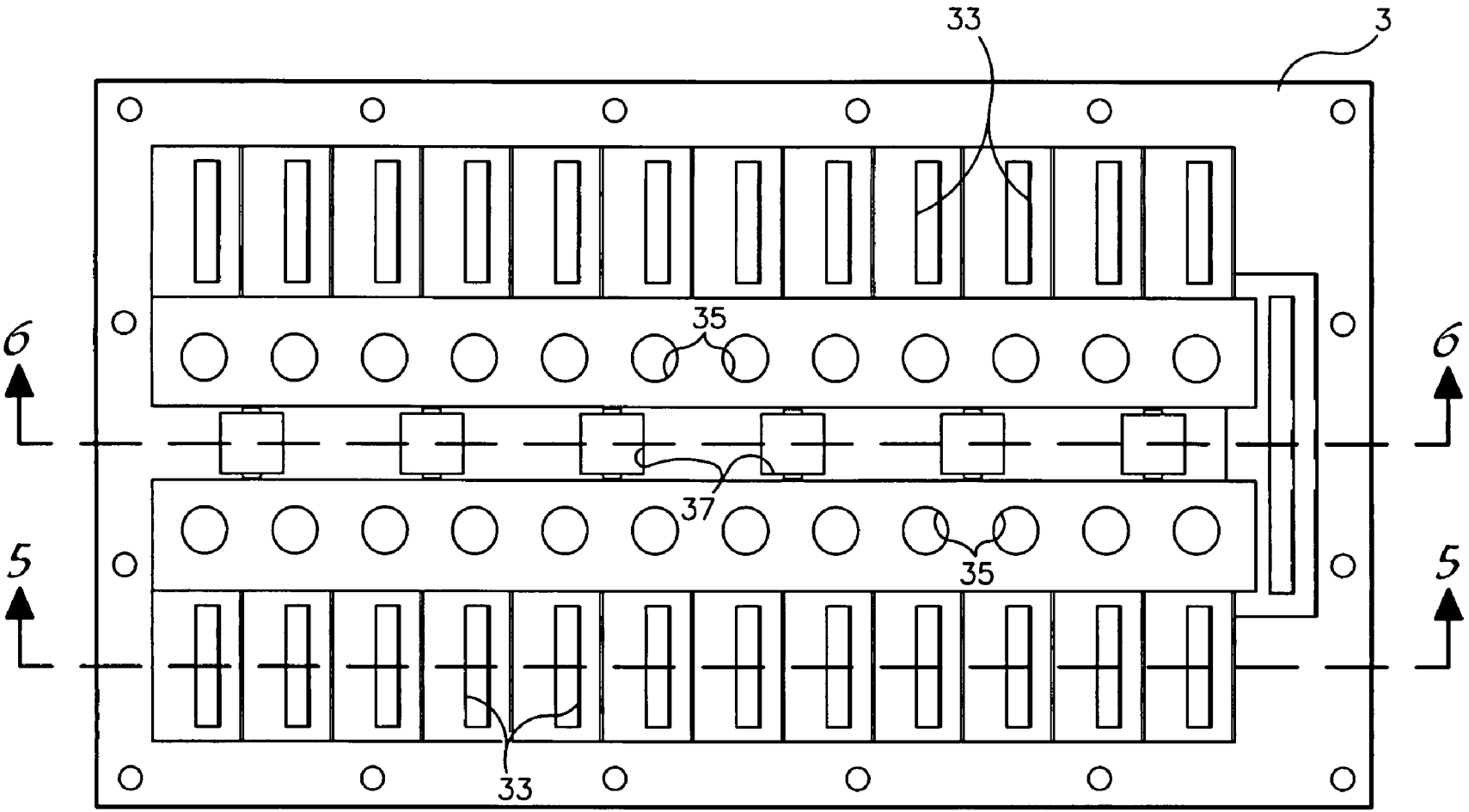
FIG. 4 is an enlarged plan view of a connector panel of the modified J-1077 box with connectors and switches removed.
Figure 5:
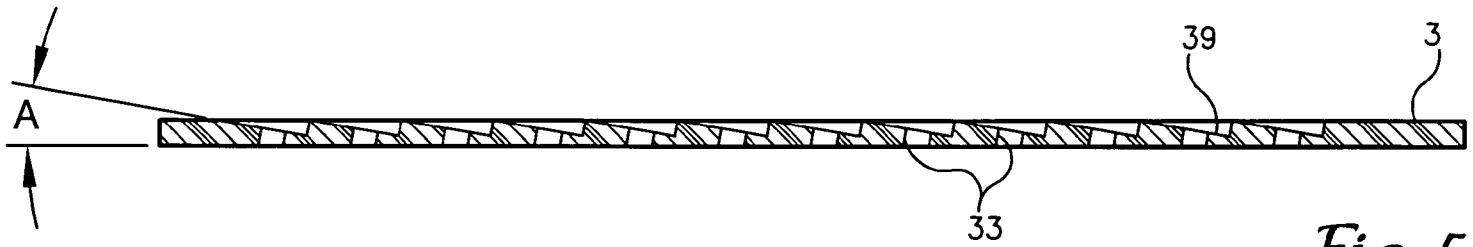
FIG. 5 is a longitudinal sectional view of the modified connector panel taken on line 5-5 of FIG. 4.
Figure 6:
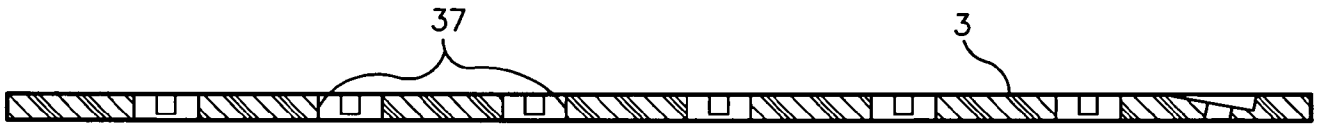
FIG. 6 is a longitudinal sectional view of the modified connector panel taken on line 6-6 of FIG. 4.

FIGS. 4-6 illustrate an improved panel 3 suitable for use with the modified distribution box 1. The panel 3 includes slots 33 to receive pairs 4 of the connector units 5, circular apertures 35 to receive the test switches 6, and square openings 37 to receive the auxiliary connectors 7. As shown in FIG. 5, the panel 3 may have its surface relieved in an angular configuration around the slots 33 at 39 to position the connector units 5 at a more convenient attitude for access by a technician.

Figure 11:
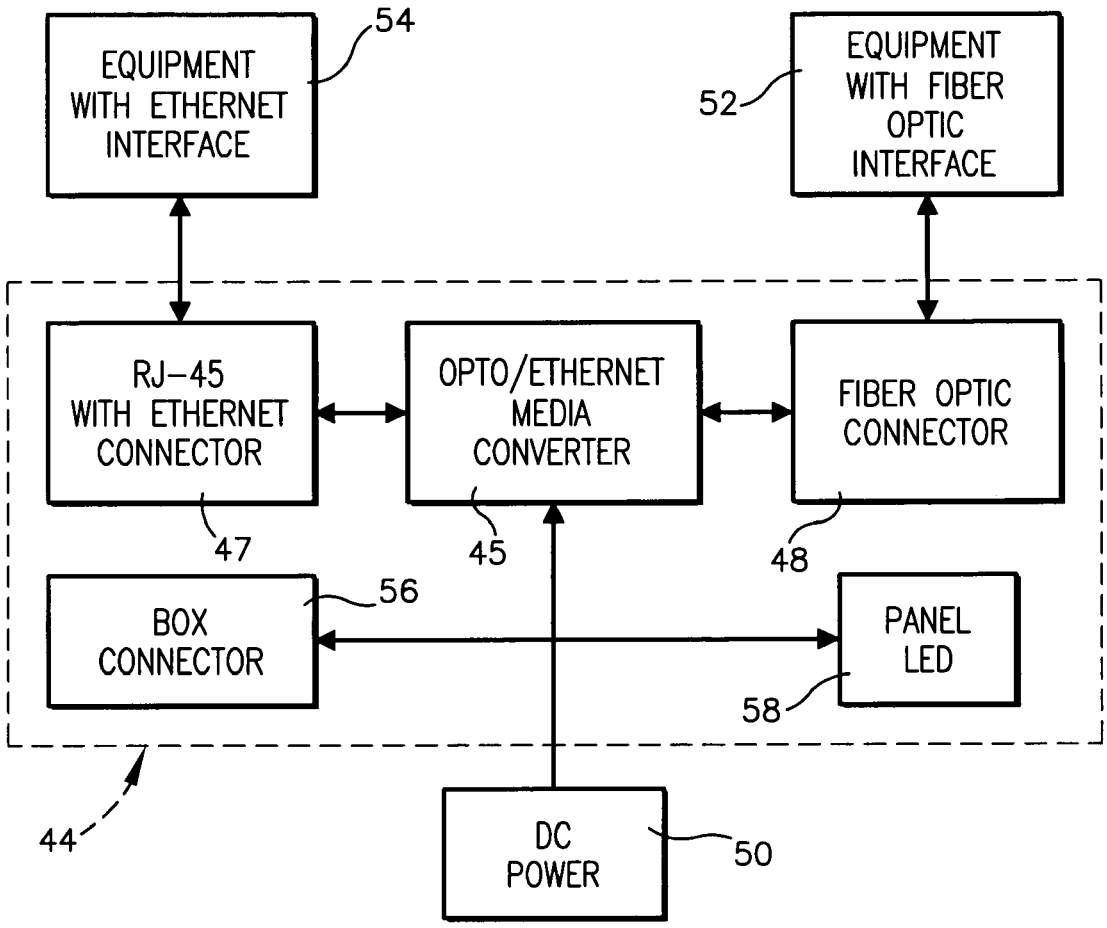
FIG. 11 is a block diagram illustrating an embodiment of a field data distribution system with a fiber optic converter according to the present invention.

FIG. 11 diagrammatically illustrates an enhanced embodiment of the distribution box 44 incorporating media converter circuitry 45 for converting data formats between an electrical data format and an optical data format. The box 44 includes auxiliary connectors 47 and 48, of which connector 47 is an electrical data connector such as an RJ-45 (8P8C) Ethernet type connector and connector 48 is an optical connector such as an ST type optical connector. In general, the media converter bilaterally or bidirectionally converts between an electrical data signal format carried by the electrical connector 47 and an optical data signal format carried by the optical connector 48. The media converter circuit 45 may, for example, be a Signamax Connectivity Systems 065-1195 unit from AESP, Inc. (www.signamax.com). It is foreseen that other types of media converter units could alternatively be employed. The illustrated media converter converts from a 1000Base-T format, a gigabit Ethernet format for a twisted pair of electrical conductors, to a 1000Base-SX format, a gigabit optical Ethernet format for carriage by an optical fiber. The illustrated media converter 45 is powered by a DC power source 50 which may be a transformer and rectifier unit plugged into a power strip or generator, a battery of the appropriate voltage, or the like. The media converter 45 allows "optical" equipment or types of equipment 52 with a fiber optic interface to communicate data with "electrical" equipment 54 having an electrical Ethernet interface and vice versa. The electrical equipment 54 can be local to the distribution box 44 or can be remote from the box 44 and connected by a cable similar to the cable 9 described above and connected to a local box connector 56, similar to the box connector 8. The box connector 56 is preferably a U-187 A/G side connector or a U-186 C/G end connector. The DC power source 50 may be connected to a panel indicator, such as an LED 58 to indicate activation of the media converter 45. The power source 50 may also be connected to the box connector 56 to provide DC power through a cable connected to the box connector 56 remote from the distribution box 44.

Figure 2:
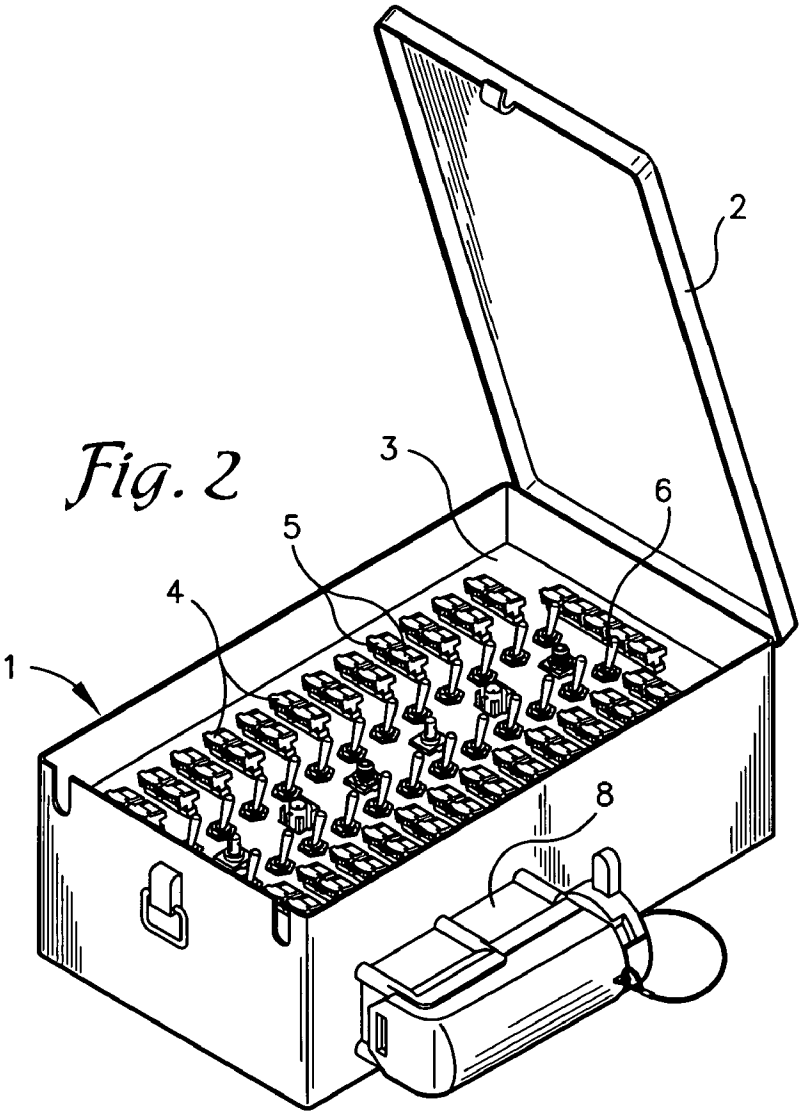
FIG. 2 is a perspective view of a J-1077 box with insulation displacement connector sets and test switches which embodies the present invention.
Figure 12:
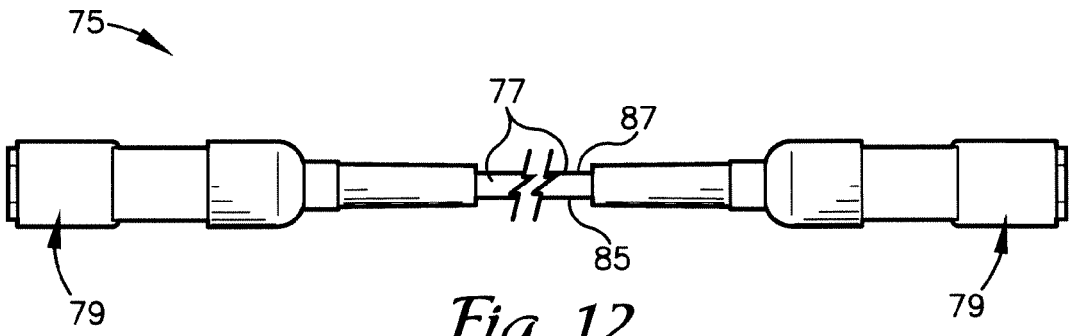
FIG. 12 is a fragmentary elevational view of an enhanced cable for a field data distribution system according to the present invention.

Referring to FIG. 12, an enhanced cable assembly 75 is illustrated which is suitable for interconnecting field distribution boxes such as the enhanced distribution boxes 44, as well as the boxes 1 shown in FIG. 2. The enhanced cable assembly 75 is similar in many respects to the cable 9 of FIG. 1 which is a CX-4566 A/G cable, with differences which will be described. The illustrated cable assembly 75 includes a cable member 77 with cable connectors 79 positioned on opposite ends. The cable member or cable proper 77 includes a plurality of pairs 81 (FIG. 13) of insulated conductor members 83 which are enclosed within a conductive shield 85 and an outer insulative sheath 87. The cable member 77 may also include an outer "armor" layer (not shown) to reduce damage to the cable member 77 from contact with rough objects in the field, such as rocks, branches, exposed tree roots, and the like, being run over by vehicles, or being chewed by animals. The illustrated cable member 77 preferably includes 26 conductor pairs 81 which are twisted at a twist pitch of three twists per inch (2.54 cm).

Figure 15:
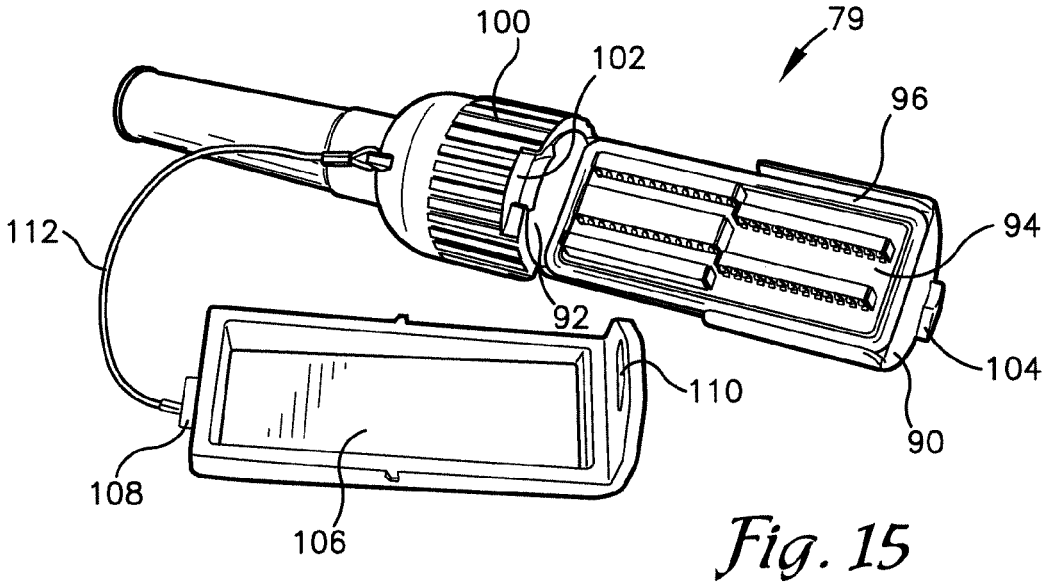
FIG. 15 is an enlarged perspective view of a U-185B/G cable connector employed with the enhanced cable.

Referring to FIG. 15, the cable connector structure 79 includes a conductive shell 90 extending from a collar base 92 through which the cable member 77 extends. The shell 90 is connected to the shield 85 of the cable member 77. A contact array board assembly 94 is secured within the shell 90 and is surrounded by a resilient weather seal 96. The connector structure 79 includes a latch mechanism 98 to retain the connector 79 secured to a box connector 56 or 8 of a distribution box 44 or 1. In the illustrated connector 79, the latch mechanism 98 takes the form of a rotary or bayonet type of collar 100 surrounding the collar base 92 and having a notch 102 formed in an edge thereof. The outer end of the shell 90 is provided with a tab 104. The collar 100 and tab 104 cooperate with similar members on a box connector 56 whereby a tab of the box connector is received through the notch 102 and the tab 104 engages a notch of a collar of the box connector. The collar 100 and the box connector collar are rotated to retain the respective tabs of the cable connector 79 and the box connector 56. The latch mechanism 98 also allows two of the cable connectors 79 to be joined and retained in a joined condition in a similar manner. When the cable connector 79 is joined to a box connector 56 or another cable connector 79, the weather seals 96 thereof are mutually engaged to seal the respective connectors against the entry of moisture. The illustrated cable connector 79 includes a connector cover 106 including a tab 108 and a tab aperture 110 which respectively engage the notch 102 and tab 104 of the cable connector 79 for retention thereon. A lanyard 112 is typically provided to prevent the cover 106 from being misplaced.

Figure 13:
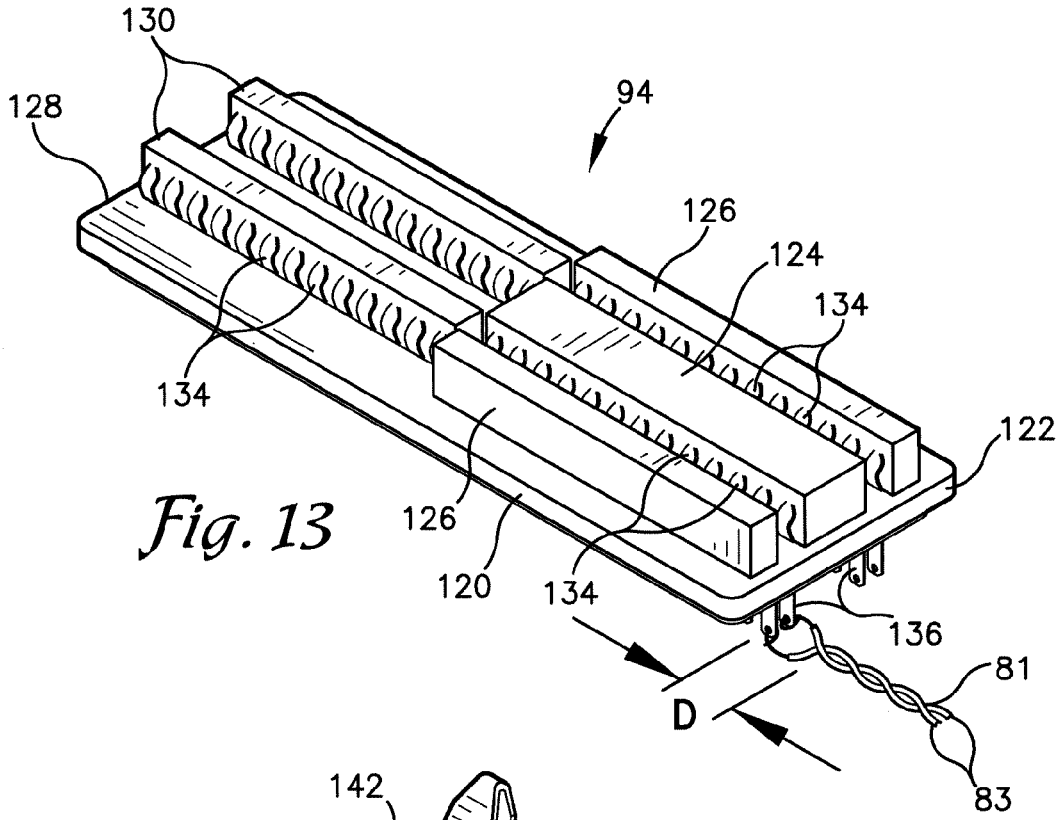
FIG. 13 is an enlarged perspective view of a contact assembly for use on the enhanced cable and on distribution boxes which the enhanced cable is employed to interconnect.
Figure 14:
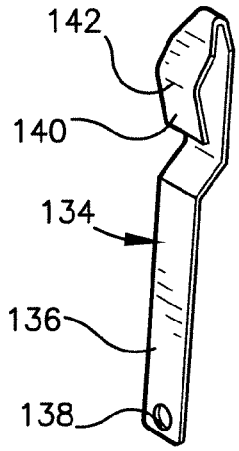
FIG. 14 is a greatly enlarged perspective view of a contact member of the contact assembly.

Referring to FIGS. 13 and 15, the contact array board assembly 94 includes a circuit board 120 with a plurality of contact support blocks positioned thereon. At an inner end 122 of the board 120, a wide center support block 124 is provided along with a pair of side support blocks 126. At an outer end 128 of the board 120, a pair of outer support blocks 130 are positioned on the assembly 94. The blocks 124, 126, and 130 are sized, shaped, and positioned so that the outer blocks 130 of one cable connector 79 or box connector 56 will fit within the spaces between the center block 124 and the side blocks 126 of another connector. The cable connectors 79 and box connectors 56 are, thus, genderless whereby any cable connector 79 can connect to a box connector 56 or another cable connector 79. The illustrated contact array board assembly 94 conforms to the specifications of the assembly having the standard designation of MX-3227/G. The illustrated cable connector 79 with the illustrated contact array board assembly 94 conforms to the type of standard cable connector designated as U-185 B/G.

The circuit board 120 and support blocks 124, 126, and 130 support a plurality of conductive contact members 134. Each contact member 134 includes a straight solder lug 136 with means such as an aperture 138 to receive a stripped end of a conductor 83 of a conductor pair 81. At an end opposite the aperture 138, a resilient contact pad 140 is formed. The illustrated contact pad 140 has a wide V-shaped ridge 142. When a cable connector 79 is joined with a box connector 56 or another cable connector 79, the ridges 142 of mutually engaging contacts 134 snap past one another to help retain the connectors together. The circuit board 120 is preferably a multi-layer circuit board with one or more internal ground plane layers (not shown) to form a shield in cooperation with the conductive shell 94. The solder lugs 136 of the contact members 134 extend through holes (not shown) in the circuit board 120 and are retained therein against the support blocks 124, 126, and 130. Each contact member 134 corresponds to a conductor 83. Each contact member 134 is replicated at opposite ends of the assembly 94 with internal traces (not shown) interconnecting the pairs of contacts 134. The patterns of contact members 134 at opposite ends of the contact array board assembly 94 are mirror images of one another so that when a cable connector 79 is connected to another cable connector or to a box connector 56, the signals are channeled to the correct conductor pairs 81.

The structure of the cable member 77 and the connectors 79 cooperate to enable the enhanced cable assembly 75 to comply with, or exceed, specifications of Category 5E, also known as Telecommunication Industry Association TIA/EIA-568-B standards. Category 5E incorporates the older Category 5 standards which enable cables to carry signals up to 100 MHz, including 100Base-T and 1000Base-T signals. Category 5E is enhanced from Category 5 with improved "far end" crosstalk performance.

In the illustrated enhanced cable assembly 75, the twist of the conductor pairs 81 is maintained within the cable connector 79 to within one half inch (12.7 mm) of their soldered connection to the solder lugs 136 of the contact members 134. This is illustrated as distance D in FIG. 13. This limitation in the untwisted portion of the conductor pairs 81 within the cable connector 79 improves the crosstalk performance of the cable assembly 75.

Figure 16:
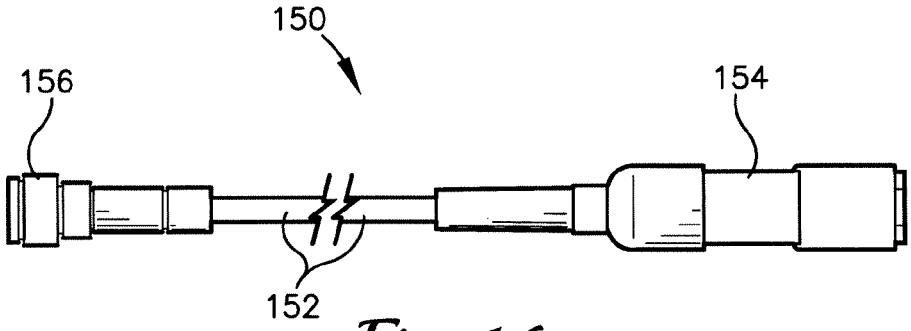
FIG. 16 is a view similar to FIG. 12 and illustrates a modified cable having a U-185 B/G cable connector at one end and a standard type of multi-terminal cylindrical connector at an opposite end.

FIG. 16 illustrates a modified embodiment 150 of the enhanced cable assembly, including a cable member 152 similar to the cable member 77, a cable connector 154 similar to the cable connectors 79 at one end of the cable member 152, and a cylindrical connector 156 at an opposite end of the cable member. The cylindrical connector 156 may be a type of multi-conductor connector designated MS-27467, alternatively designated AE167. Such cylindrical connectors 156 are more compact than the cable connectors 154 for joining two cables 150 having properly gendered versions of the cylindrical connectors 156. The modified enhanced cable assembly 150 complies with, or exceeds, Category 5E specifications. In other respects, the cable assembly 150 is substantially similar to the enhanced cable assembly 75.

It is to be understood that while certain forms of the present invention have been illustrated and described herein, it is not to be limited to the specific forms or arrangement of parts described and shown.

What is claimed and desired to secure by Letters Patent is:

1. A field communication distribution cable assembly for use with field communication distribution box including a box connector of a selected box connector configuration and having a plurality of sets of box contacts positioned in a selected box contact pattern, said cable assembly comprising:

(a) a plurality of elongated cable conductor pairs, each conductor pair including a pair of insulated conductor members, said insulated conductor members of each pair being twisted at a selected twist pitch;

(b) said plurality of cable conductor pairs being positioned within an elongated tubular conductive shield;

(c) said plurality of cable conductor pairs within said shield being positioned within an elongated tubular insulative sheath;

(d) said conductor pairs, said shield, and said sheath cooperating to form a multi-conductor cable member having opposite ends;

(e) a multi-terminal cable connector having a plurality of sets of cable contacts positioned thereon in a cable contact pattern corresponding to said box contact pattern, said connector being connected to an end of said cable member with said plurality of conductor pairs being connected respectively to said sets of cable contacts, and said cable connector having a cable connector configuration compatible with said box connector configuration to enable said cable connector to be removably joined to said box connector or to a cable connector of another cable assembly; and (e) said conductor pairs and said cable connector being configured in such a manner as to comply with at least Category 5E specifications.

2. An assembly as set forth in claim 1 wherein:

(a) said box connector configuration is a of a type of standard connector configuration designated U-187 A/G or U-186 C/G; and (b) said cable connector configuration is of a type of standard connector configuration designated U-185 B/G.

3. An assembly as set forth in claim 1 wherein:

(a) said multi-terminal cable connector is a first multi-terminal cable connector positioned at a first end of said cable member; and (b) a second multi-terminal cable connector, substantially similar to said first multi-terminal cable connector, is positioned at a second end of said cable member and includes a plurality of sets of cable contacts connected respectively to said conductor pairs of said cable member.

4. An assembly as set forth in claim 1 wherein:

(a) said multi-terminal cable connector is a first multi-terminal cable connector positioned at a first end of said cable member; and (b) a second multi-terminal cable connector is positioned at a second end of said cable member and includes a plurality of sets of cable contacts connected respectively to said conductor pairs of said cable member, said second multi-terminal cable connector being of a standard configuration which is different from said first multi-terminal cable connector.

5. An assembly as set forth in claim 1 wherein said multi-terminal cable connector includes:

(a) a conductive connector shell connected to said shield of said cable member;

(b) a cable contact circuit board secured to said connector shell and having said sets of cable contacts positioned thereon in said cable contact pattern, said board being of such a construction and cooperating with said shell in such a manner as to form an electrically shielded space within which said conductor members are connected to said cable contacts; and (c) a cable connector latch mechanism engaged with said connector shell to releasably secure said cable connector with a box connector of a field communication distribution box or with a cable connector of another cable assembly.

6. An assembly as set forth in claim 5 wherein:

(a) said cable contact circuit board conforms to a standard contact circuit board configuration designated MX-3227/G.

7. An assembly as set forth in claim 5 wherein:

(a) the twist of each conductor pair is maintained to within one half inch (12.7 millimeters) of a set of cable contacts to which said conductor pair is connected within said cable connector.

8. An assembly as set forth in claim 5 wherein:

(a) each of said cable contacts is resilient and shaped in such a manner that said cable contacts resiliently snap past corresponding box contacts of a box connector or corresponding cable contacts of another cable assembly.

9. An assembly as set forth in claim 1 wherein:

(a) said cable member includes 26 of said elongated cable conductor pairs.

10. A field communication distribution cable assembly for use with field communication distribution box including a box connector of a standard configuration designated U-187 A/G and having a plurality of sets of box contacts positioned in a selected box contact pattern, said cable assembly comprising:

(a) a plurality of elongated cable conductor pairs, each conductor pair including a pair of insulated conductor members, said insulated conductor members of each pair being twisted at a selected twist pitch;

(b) said plurality of cable conductor pairs being positioned within an elongated tubular conductive shield;

(c) said plurality of cable conductor pairs within said shield being positioned within an elongated tubular insulative sheath;

(d) said conductor pairs, said shield, and said sheath cooperating to form a multi-conductor cable member having opposite ends;

(e) multi-terminal cable connector of a standard configuration designated U-185 B/G and including:

(1) a conductive connector shell connected to said shield of said cable member;

(2) a cable contact circuit board secured to said connector shell and having sets of cable contacts positioned thereon, said cable contact circuit board conforming to a standard contact circuit board configuration designated MX-3227/G, and said board being of such a construction and cooperating with said shell in such a manner as to form an electrically shielded space within which said conductor members are connected to said cable contacts; and (3) a cable connector latch mechanism engaged with said connector shell to releasably secure said cable connector with a box connector of a field communication distribution box or with a cable connector of another cable assembly.

(f) said multi-terminal cable connector being connected to an end of said cable member with said plurality of conductor pairs being connected respectively to said sets of cable contacts, and said cable connector being removably joined to said box connector or to a cable connector of another cable assembly; and (g) said conductor pairs and said cable connector being configured in such a manner as to comply with at least Category 5E specifications.

11. An assembly as set forth in claim 10 wherein:

(a) said multi-terminal cable connector is a first multi-terminal cable connector positioned at a first end of said cable member; and (b) a second multi-terminal cable connector, substantially similar to said first multi-terminal cable connector, is positioned at a second end of said cable member and includes a plurality of sets of cable contacts connected respectively to said conductor pairs of said cable member.

12. An assembly as set forth in claim 10 wherein:

(a) said multi-terminal cable connector is a first multi-terminal cable connector positioned at a first end of said cable member; and (b) a second multi-terminal cable connector is positioned at a second end of said cable member and includes a plurality of sets of cable contacts connected respectively to said conductor pairs of said cable member, said second multi-terminal cable connector being of a standard configuration which is different from said first multi-terminal cable connector.

13. An assembly as set forth in claim 10 wherein:

(a) the twist of each conductor pair is maintained to within one half inch (12.7 millimeters) of a set of cable contacts to which said conductor pair is connected within said cable connector.

14. An assembly as set forth in claim 10 wherein:

(a) each of said cable contacts is resilient and shaped in such a manner that said cable contacts resiliently snap past corresponding box contacts of a box connector or corresponding cable contacts of another cable assembly.

15. An assembly as set forth in claim 10 wherein:

(a) said cable member includes 26 of said elongated cable conductor pairs.

16. A field communication distribution apparatus for use with a cable formed by a plurality of cable conductor pairs to enable temporary connection of communication devices to said conductor pairs, said cable terminating in a cable connector including pairs of terminals for each of said conductor pairs, said apparatus comprising:

(a) a weatherproof housing;

(b) a panel positioned in said housing and having a plurality of connector devices mounted thereon, each of said connector devices including a pair of insulation displacement connectors therein which enable connection thereto of unstripped insulated conductors of a communication device;

(c) a box connector having a plurality of sets of box contacts positioned in a selected box contact pattern, each of said sets of box contacts being connected to a respective pair of insulation displacement connectors of one of said connector devices;

(d) a plurality of auxiliary connectors mounted on said panel, each of said auxiliary connectors having respective auxiliary connector terminals connected to the insulation displacement connectors of a selected connector device, said auxiliary connectors being of standard configurations to enable connection of communication devices having connectors compatible respectively with said auxiliary connectors to selected conductor pairs of said cable;

(e) an electrical data connector mounted on said panel and configured to carry an electrical data signal;

(f) an optical connector mounted on said panel and configured to carry an optical data signal;

(g) media converter circuitry coupled between said electrical data connector and said optical connector and bilaterally converting between an electrical data signal received at said electrical data connector to an optical data signal at said optical connector or between an optical data signal received at said optical connector to an electrical data signal at said electrical data connector; and (h) a field communication distribution cable assembly including:

(1) a plurality of elongated cable conductor pairs, each conductor pair including a pair of insulated conductor members, said insulated conductor members of each pair being twisted at a selected twist pitch;

(2) said plurality of cable conductor pairs being positioned within an elongated tubular conductive shield;

(3) said plurality of cable conductor pairs within said shield being positioned within an elongated tubular insulative sheath;

(4) said conductor pairs, said shield, and said sheath cooperating to form a multi-conductor cable member having opposite ends;

(5) a multi-terminal cable connector having a plurality of sets of cable contacts positioned thereon in a cable contact pattern corresponding to said box contact pattern, said connector being connected to an end of said cable member with said plurality of conductor pairs being connected respectively to said sets of cable contacts, and said cable connector having a cable connector configuration compatible with said box connector configuration to enable said cable connector to be removably joined to said box connector or to a cable connector of another cable assembly; and (6) said conductor pairs and said cable connector being configured in such a manner as to comply with at least Category 5E specifications.

17. An assembly as set forth in claim 16 wherein:

(a) said box connector configuration is a of a type of standard connector configuration designated U-187 A/G; and (b) said cable connector configuration is of a type of standard connector configuration designated U-185 B/G.

18. An assembly as set forth in claim 16 wherein:

(a) said multi-terminal cable connector is a first multi-terminal cable connector positioned at a first end of said cable member; and (b) a second multi-terminal cable connector, substantially similar to said first multi-terminal cable connector, is positioned at a second end of said cable member and includes a plurality of sets of cable contacts connected respectively to said conductor pairs of said cable member.

19. An assembly as set forth in claim 16 wherein:

(a) said multi-terminal cable connector is a first multi-terminal cable connector positioned at a first end of said cable member; and (b) a second multi-terminal cable connector is positioned at a second end of said cable member and includes a plurality of sets of cable contacts connected respectively to said conductor pairs of said cable member, said second multi-terminal cable connector being of a standard configuration which is different from said first multi-terminal cable connector.

20. An assembly as set forth in claim 16 wherein said multi-terminal cable connector includes:

(a) a conductive connector shell connected to said shield of said cable member;

(b) a cable contact circuit board secured to said connector shell and having said sets of cable contacts positioned thereon in said cable contact pattern, said board being of such a construction and cooperating with said shell in such a manner as to form an electrically shielded space within which said conductor members are connected to said cable contacts; and (c) a cable connector latch mechanism engaged with said connector shell to releasably secure said cable connector with a box connector of a field communication distribution box or with a cable connector of another cable assembly.

21. An assembly as set forth in claim 20 wherein:

(a) said cable contact circuit board conforms to a standard contact circuit board configuration designated MX-3227/G.

22. An assembly as set forth in claim 20 wherein:

(a) the twist of each conductor pair is maintained to within one half inch (12.7 millimeters) of a set of cable contacts to which said conductor pair is connected within said cable connector.

23. An assembly as set forth in claim 20 wherein:

(a) each of said cable contacts is resilient and shaped in such a manner that said cable contacts resiliently snap past corresponding box contacts of said box connector or corresponding cable contacts of another cable assembly.

24. An assembly as set forth in claim 16 wherein:

(a) said cable member includes 26 of said elongated cable conductor pairs.

* * * * *